US005982287A

United States Patent [19]

Brannen et al.

[11] Patent Number: 5,982,287

[45] Date of Patent: Nov. 9, 1999

[54] SLEEP PREVENTION APPARATUS AND METHOD

[75] Inventors: Michael Brannen, 3560 San Pedro Dr., NE., Albuquerque, N. Mex. 87110; Steve Sanderson, Albuquerque, N. Mex.

[73] Assignee: Michael Brannen, Albuquerque, N. Mex.

[21] Appl. No.: 09/002,183

[22] Filed: Dec. 31, 1997

[51] Int. Cl.[6] ..... G08B 21/00

[52] U.S. Cl. ..... 340/575; 340/576; 340/691.1; 340/692; 340/693.6

[58] Field of Search ..... 340/575, 576, 340/691, 692, 693, 691.1, 693.5, 693.6

[56] References Cited

U.S. PATENT DOCUMENTS

| | | | |
|---|---|---|---|
| 2,210,330 | 8/1940 | Sequin et al. . | |
| 3,524,030 | 8/1970 | Wiegel . | |
| 3,903,514 | 9/1975 | Mazzola . | |
| 4,144,531 | 3/1979 | Anbergen | 340/575 |
| 4,354,179 | 10/1982 | Fourcade . | |
| 4,836,219 | 6/1989 | Hobson et al. . | |
| 4,875,030 | 10/1989 | Chiu . | |
| 4,967,186 | 10/1990 | Ludmirsky et al. . | |
| 5,353,013 | 10/1994 | Estrada | 340/576 |
| 5,402,109 | 3/1995 | Mannik | 340/576 |
| 5,469,143 | 11/1995 | Cooper | 340/575 |
| 5,488,354 | 1/1996 | Colvin . | |
| 5,522,092 | 6/1996 | Streb et al. . | |
| 5,566,067 | 10/1996 | Hobson et al. | 340/575 |
| 5,682,144 | 10/1997 | Mannik | 340/575 |

*Primary Examiner*—Glen Swann

*Attorney, Agent, or Firm*—Deborah A. Peacock; Rod D. Baker; Jeffrey D. Myers

[57] ABSTRACT

A method and apparatus for detecting drowsiness and awakening the user. The load on a piezo-ceramic eye blinking detection unit changes upon blinking activity resulting in an electrical output. This electrical output is then processed and compared to a predetermined time interval for blinking. An alarm is sounded if the processed electrical output is less than the predetermined time interval.

10 Claims, 4 Drawing Sheets

SLEEP PREVENTION APPARATUS AND METHOD

BACKGROUND OF THE INVENTION

1. Field of the Invention (Technical Field)

The present invention relates to the field of sleep prevention, and more particularly to a method and an apparatus for detecting and awakening a person who is becoming drowsy.

2. Background Art

The maintenance of a state of wakefulness while performing various tasks is needed for a range of reasons varying from safety to efficient performance and beyond. In order to decrease the possibility of accidents, alertness while operating vehicles, such as automobiles or heavy machinery, must be maintained. Additionally, reading and studying require wakefulness.

There are several devices described in the prior art which detect drowsiness and awaken the user upon its detection. While many base their determinations on eyelid motion and a predetermined blink frequency, for various reasons they have caused discomfort for the user. For example, several patents require a "feeler" element which maintains contact with the user's eyelid (e.g., U.S. Pat. No. 5,469,143, entitled "Sleep Awakening Device For Driver Of Motor Vehicles," to Cooper). Others shine beams of light either into the user's eye or across the line of vision such as disclosed in U.S. Pat. No. 4,967,186, entitled "Method And Apparatus For Fatigue Detection," to Ludmirsky, et al., and U.S. Pat. No. 4,144,531, entitled "Drowsiness Detecting Apparatus," to Anbergen.

Not all prior art devices determine drowsiness based on eyelid motion; there are several which monitor head inclination. These seem to be particularly designed for operators of vehicles. They are mounted in different ways: On the headrest (U.S. Pat. No. 3,903,514, entitled "Stay Awake Alarm," to Mazzola); in a collar (U.S. Pat. No. 5,488,354, entitled "Snooze Alert Device," to Colvin); or in a cap (U.S. Pat. No. 5,522,092, entitled "Cap With Sleep Posture Alarm," to Streb, et al.). U.S. Pat. No. 4,463,347, entitled "Drowsiness Alarm System For A Vehicle," to Seko, et al., bases its determination on changes in the angle of the steering wheel. Still another, U.S. Pat. No. 5,311,877, entitled "Waking Degree Maintaining Apparatus," to Kishi, teaches correlating brain waves to reaction time.

SUMMARY OF THE INVENTION (DISCLOSURE OF THE INVENTION)

The present invention is of a method and apparatus for preventing sleep comprising: providing an eye activity detection unit and a power supply; proximately locating the eye activity detection unit to an eye of a user; filtering and amplifying an output of the eye activity detection unit; comparing a filtered and amplified output of the eye activity detection unit to a predetermined time interval; and creating an alarm. In the preferred embodiment, the eye activity detection unit comprises an optical sensor aligned with the eye or a piezo-ceramic element which also creates the alarm. The eye activity detection unit may be located via use of a pair of eyeglasses or an adhesive. Comparing preferably is done by a variable timeout circuit. The alarm is preferably generated by a buzzer, and most preferably by a ceramic disk buzzer.

A primary object of the present invention is to provide a device and method for detecting drowsiness and awakening the device user.

A primary advantage of the present invention is that does not require obtrusive or potentially harmful contact with the user.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

(BEST MODES FOR CARRYING OUT THE INVENTION)

The present invention is of an apparatus for preventing sleep. In one embodiment, an optical sensor functions as an eye activity detection unit. The optical sensor is located within inches of a user's eye. The electrical output of the optical sensor is then filtered and amplified, the result of which is compared to a predetermined time interval for blinking. When the filtered and amplified signal is less than the predetermined limit, an audible tone is sounded to awaken the user. Both the optical sensor and the processing circuitry require power to function. One way to locate the optical sensor close to the user's eyes is to mount it on a pair of eyeglasses. Further, in order to correctly align the sensor with an individual user's eye, an adjustor may be needed. The audible tone is preferably created through the use of a ceramic disc buzzer.

In a second embodiment of the present invention, a piezo-ceramic element functions as an eye activity detection unit. The piezo-ceramic element is located within inches of the user's eye. After filtering and amplification, the output signal of the piezo-ceramic element is compared to a predetermined time interval for blinking. When the filtered and amplified signal is less than the predetermined limit, an audible tone is sounded to awaken the user. The processing circuitry requires power to function. An adhesive may be needed to locate the piezo-ceramic element close to the user's eye. The piezo-ceramic element may also incorporate the ability to sound the awakening tone.

In any case, the comparison of the filtered and amplified signal to the predetermined limit may be accomplished through the use of a variable timeout circuit. Power may be supplied through the use of a battery which may be rechargeable.

Figure 1:
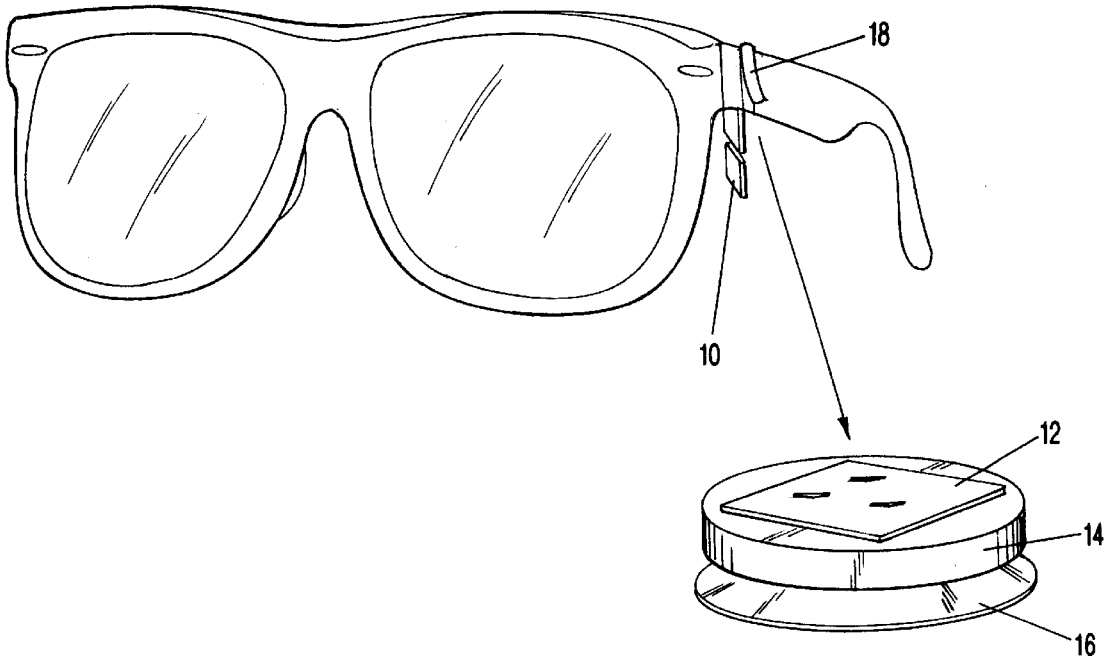
FIG. 1 illustrates the optical sensor embodiment of the invention.

Reference is now made to FIG. 1 which illustrates the optical sensor embodiment of the invention. This embodiment necessitates the use of a means for locating optical sensor 10 near the eye of the user. In FIG. 1, optical sensor 10 is attached to a pair of eyeglasses in order to achieve this positioning. In order to correctly align optical sensor 10 with the eye of the individual user, a means for adjustment 18 is used. The eye activity of the user which optical sensor 10 detects is then processed as a electrical signal through circuitry contained on circuit board 12. Upon the determination that the signal is less than a predetermined time interval for blinking, ceramic disc buzzer 16 will sound an audible tone. The entire device is powered by battery 14.

Figure 3A:
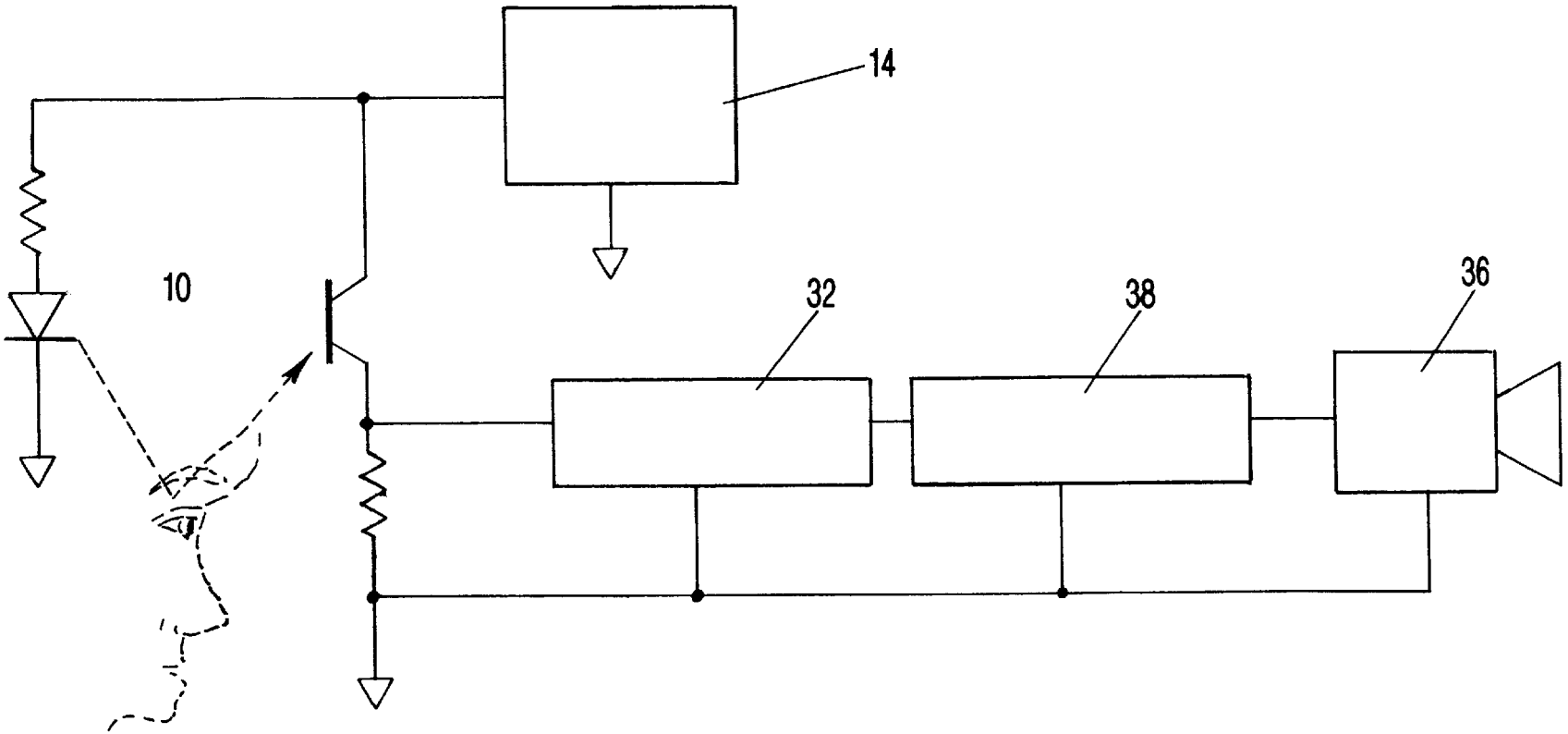
FIG. 3 illustrates circuit schematics for processing the output for both the FIG. 1 embodiment and the FIG. 2 embodiment.
Figure 3B:
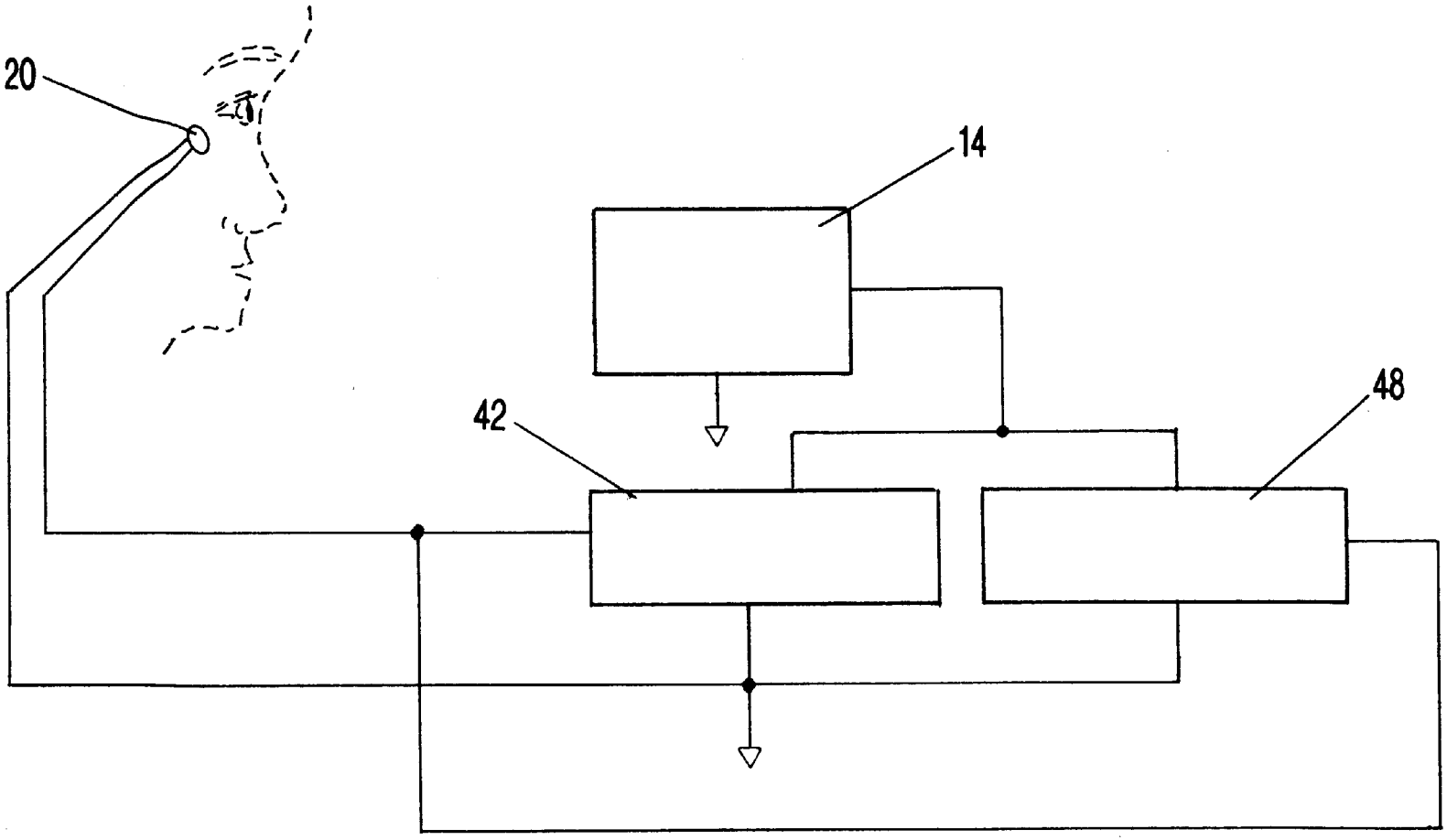

The circuitry contained on circuit board 12 of FIG. 1, is illustrated in FIG. 3. In FIG. 3, battery 14 supplies power to optical sensor 10 and the processing circuit. Optical sensor 10 detects the eye activity of the user and outputs an electrical signal. That signal is then amplified and filtered by amplifier/filter 32. Variable timeout circuit 38 compares the filtered and amplified signal with the predetermined time interval for blinking. Alarm tone 36 sounds when the signal is less than the predetermined limit.

Figure 2:
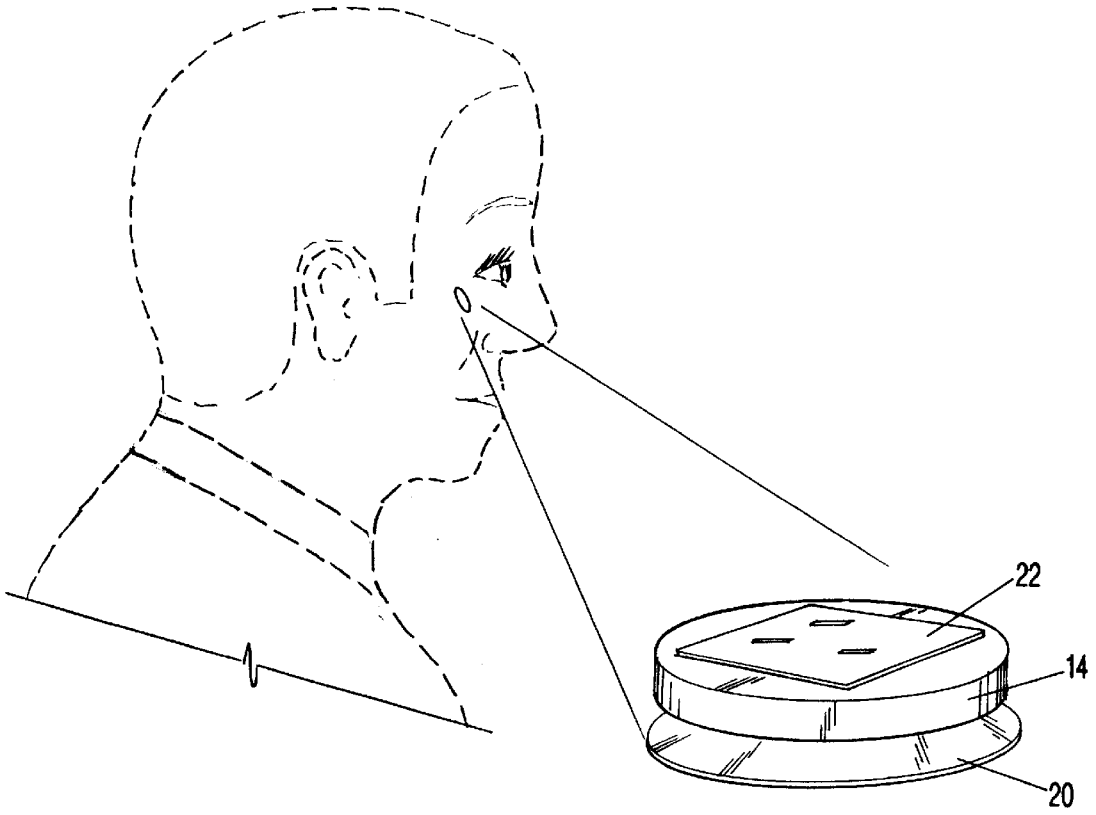
FIG. 2 illustrates the piezo-ceramic element embodiment of the invention.

Reference is now made to FIG. 2 which illustrates the piezo-ceramic element embodiment of the invention. In FIG. 2, piezo-ceramic disc sensor/buzzer 20 is located near the eye of the user. A piezo-ceramic element emits electrical charges in response to mechanical loading. In other words, such elements produce an electrical output when they experience a change in load. The electrical output of piezo-ceramic element 20 is then processed through circuitry contained on circuit board 22. Upon the determination that the signal is less than a predetermined time interval for blinking, piezo-ceramic disc buzzer 20 sounds an audible tone. The processing circuitry is powered by battery 14.

The circuitry contained on circuit board 22 of FIG. 2 is illustrated in FIG. 3. In FIG. 3, battery 14 supplies power to the processing circuit. When the user evinces eye activity, the load on piezo-ceramic element 20 changes, resulting in an electrical output. That output is then amplified and filtered by amplifier/filter 42. Variable timeout circuit 48 compares the filtered and amplified signal with the predetermined time interval for blinking. The alarm out signal is sent back to piezo-ceramic element 20 which creates an audible tone when the signal is less than the predetermined limit.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An apparatus for preventing sleep, said apparatus comprising:

an eye blinking detection unit, located proximate to an eye of a user but not on an eyelid, comprising a piezo-ceramic disc sensor;

means for locating said eye blinking detection unit proximate to an eye of a user;

means for filtering and amplifying an output of said eye blinking detection unit;

a variable timeout circuit for comparing the output of said eye blinking detection unit to a predetermined time interval;

means for creating an alarm when the output is less than said predetermined time interval; and a power supply connected to said variable timeout circuit, said means for filtering and amplifying, and said means for creating an alarm.

2. The apparatus of claim 1 wherein said piezo-ceramic disc sensor comprises said means for creating an alarm.

3. The apparatus of claim 1 wherein said means for locating comprises an adhesive.

4. The apparatus of claim 1 wherein said means for creating an alarm comprises a buzzer.

5. The apparatus of claim 4 wherein said buzzer comprises a ceramic disc.

6. A method for preventing sleep, the method comprising the steps of:

a) providing a piezo-ceramic disc sensor and a power supply;

b) proximately locating the piezo-ceramic disc sensor for detecting eye blinking to an eye of a user, but not on an eyelid;

c) filtering and amplifying an output of the piezo-ceramic disc sensor;

d) comparing with a variable timeout circuit the output of the piezo-ceramic disc sensor to a predetermined time interval; and e) creating an alarm when the output is less than the predetermined time interval.

7. The method of claim 6 wherein the step of providing a piezo-ceramic disc sensor further comprises providing means for creating an alarm.

8. The method of claim 6 wherein the step of proximately locating comprises employing an adhesive.

9. The method of claim 6 wherein the step of creating an alarm comprises employing a buzzer.

10. The method of claim 9 wherein the step of employing a buzzer comprises employing a ceramic disc.

* * * * *